US005450888A

United States Patent [19]

Schwartzman et al.

[11] Patent Number: 5,450,888

[45] Date of Patent: Sep. 19, 1995

[54] SECURITY SCREEN

[75] Inventors: Benjamin Schwartzman, Harrisburg; Todd Root, York, both of Pa.

[73] Assignee: Root Corporation, Mount Wolf, Pa.

[21] Appl. No.: 137,478

[22] Filed: Oct. 18, 1993

[51] Int. Cl.[6] ..... G08B 13/08

[52] U.S. Cl. ..... 160/10; 160/290.1; 340/550

[58] Field of Search ..... 160/10, 23.1, 290.1, 160/237, 127, 128, 270, 271; 340/545, 547, 541, 550

[56] References Cited

U.S. PATENT DOCUMENTS

| | | | |
|---|---|---|---|
| 18,314 | 10/1876 | Cope . | |
| 1,093,272 | 4/1914 | Jones . | |
| 1,140,413 | 5/1915 | Stanley . | |
| 1,221,564 | 4/1917 | Mills . | |
| 1,299,016 | 4/1919 | Opitz . | |
| 2,055,862 | 9/1936 | Friedman . | |
| 2,316,027 | 4/1943 | Swormstedt . | |
| 3,696,373 | 10/1972 | Dunn et al. | 160/10 X |
| 3,871,434 | 3/1975 | Hance . | |
| 4,006,768 | 2/1977 | Horgan, Jr. . | |
| 4,160,972 | 7/1979 | LaMell et al. | 160/178.1 R X |
| 4,170,947 | 10/1979 | Morgan . | |
| 4,232,310 | 11/1980 | Wilson . | |
| 4,267,874 | 5/1981 | Pope . | |
| 4,272,922 | 6/1981 | Prager . | |
| 4,545,148 | 10/1985 | Shaw . | |
| 4,593,492 | 6/1986 | Lumenello . | |
| 4,757,852 | 7/1988 | Jentof et al. | 160/23.1 |
| 4,758,824 | 7/1988 | Young | 160/178.1 X |
| 4,796,384 | 1/1989 | Warick . | |
| 4,878,314 | 11/1989 | Blockinger . | |
| 4,971,130 | 11/1990 | Bentley | 160/127 X |
| 4,999,608 | 3/1991 | Galomb . | |
| 5,049,855 | 9/1991 | Slemon et al. . | |
| 5,056,262 | 10/1991 | Schweiss et al. . | |
| 5,090,468 | 2/1992 | Tedeschi | 160/290.1 |
| 5,274,357 | 12/1993 | Riordan | 160/10 X |

*Primary Examiner*—David M. Purol
*Attorney, Agent, or Firm*—Shoemaker and Mattare, Ltd.

[57] ABSTRACT

A security screen includes a rectangular frame including a top member containing a screen reel comprising a rotatable core with a length of electrically non-conductive screen material affixed thereto. The screen contains parallel electrical conductors therein running lengthwise, and transverse conductors interconnect selected pairs of the lengthwise conductors to form therewith a single continuous electrical path which is interrupted if the screen is cut. A latchable drawbar is affixed along the lower edge of the screen, so that the screen can be drawn closed, against the bias provided by two torsion springs. One end of each spring is connected to the reel's core; its other end is attached to a stationary stub shaft, which serves as a terminal for connection to an alarm. The springs are electrically joined to opposite ends of the screen's conductor path, thus serving as non-sliding rotary electrical joints.

18 Claims, 4 Drawing Sheets

FIG. 2
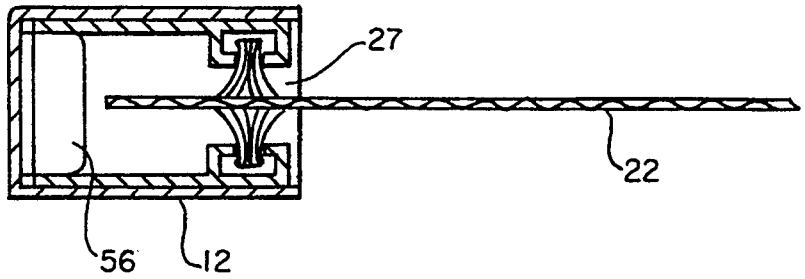
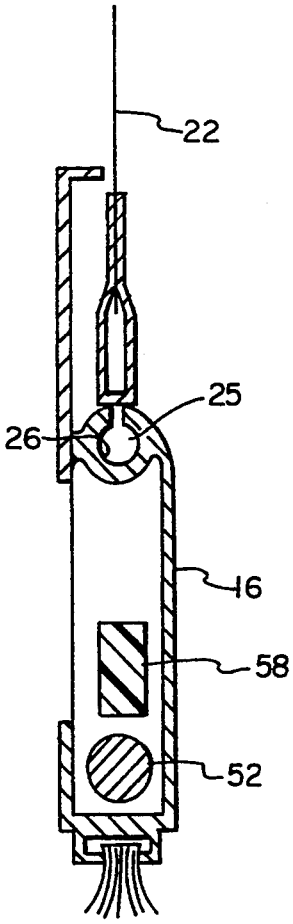
FIG. 4
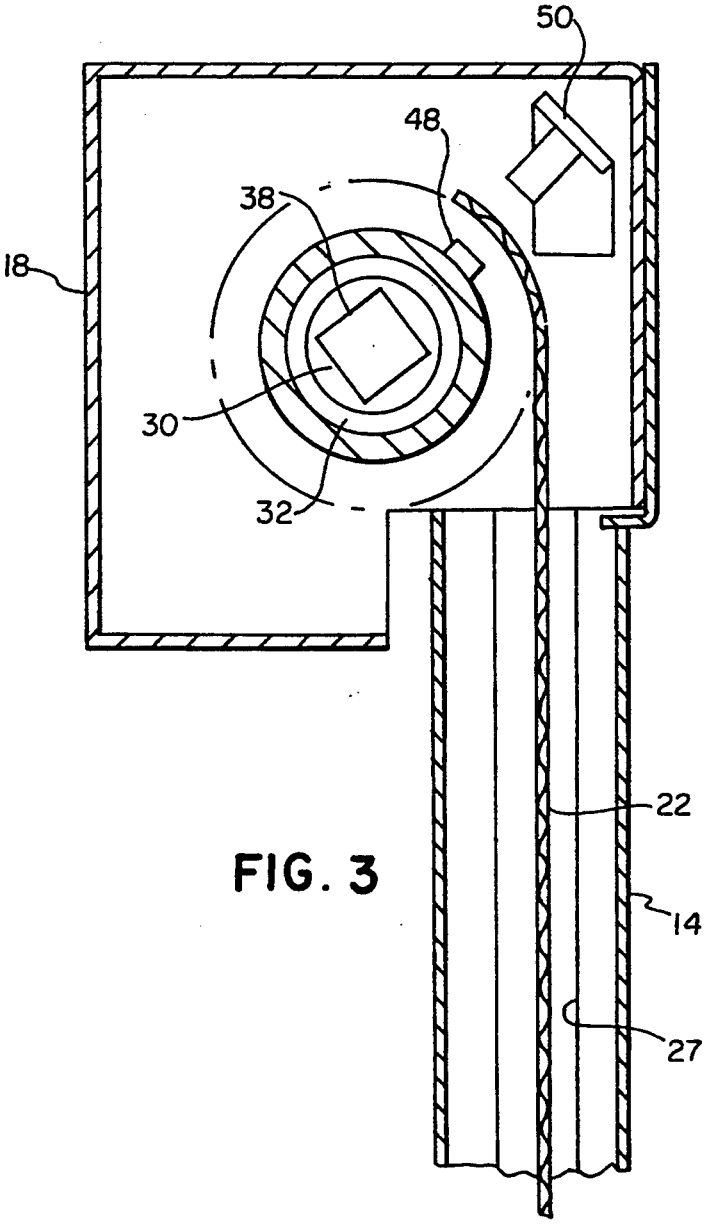
FIG. 3

SECURITY SCREEN

BACKGROUND OF THE INVENTION

This invention relates generally to closures and more particularly to a security window screen having locking and alarm features to discourage break-ins.

A window screen, while not a significant barrier to forcible entry, may impede or prevent entry by stealth, particularly if it is part of an alarm system. Prior inventors have proposed providing window screens with wires which, when tampered with, open a circuit and sound an alarm.

Other inventors have developed window screens in which the screen rolls up on a reel, like a window shade, when the screen is raised. To provide such a screen with alarm wiring, however, is difficult to do satisfactorily because the involvement of moving parts has necessitated sliding electrical contacts, which are inherently unreliable in the long term.

The present invention proposes to provide a reel-type window screen unit with a number of devices for sounding an alarm, thereby to prevent stealthful entry through the screen when an associated alarm is active.

SUMMARY OF THE INVENTION

An object of the invention is to improve the security provided by a locking window screen. By "security", we mean protection against break-ins.

A further object of the invention is to eliminate the need for brushes or other sliding electrical contacts in a security screen.

These and other objects are attained by a security screen including a frame whose top member contains a screen reel carrying a length of electrically non-conductive screen material. The screen has longitudinal electrical conductors therein running lengthwise at intervals, and hidden transverse conductors interconnecting selected pairs of the lengthwise conductors to form therewith a single, continuous but non-serpentine electrical path which is interrupted if the screen is cut. A latchable drawbar is affixed along the lower edge of the screen, so that the screen can be drawn closed, against the bias of two torsion springs within the reel. One end of each spring is mechanically connected to the reel's core, and electrically connected to one end of the conductor path; its other end is attached to one of a pair of stationary stub shafts, which are electrically isolated from one another. The springs thus serve as non-sliding rotary electrical joints.

The invention additionally provides at least one magnetic sensor for detecting movement of the reel, and a separate magnetic sensor on the frame, opposite the latchable drawbar when the screen in closed, to detect raising of the drawbar.

BRIEF DESCRIPTION OF THE DRAWINGS

In the accompanying drawings,

FIG. 2 is a sectional view taken on the line 2—2 in FIG. 1;

FIG. 3 is a sectional view taken on the line 3—3 in FIG. 1;

FIG. 4 is a sectional view taken on the line 4—4 in FIG. 1;

DESCRIPTION OF THE PREFERRED EMBODIMENT

Figure 1:
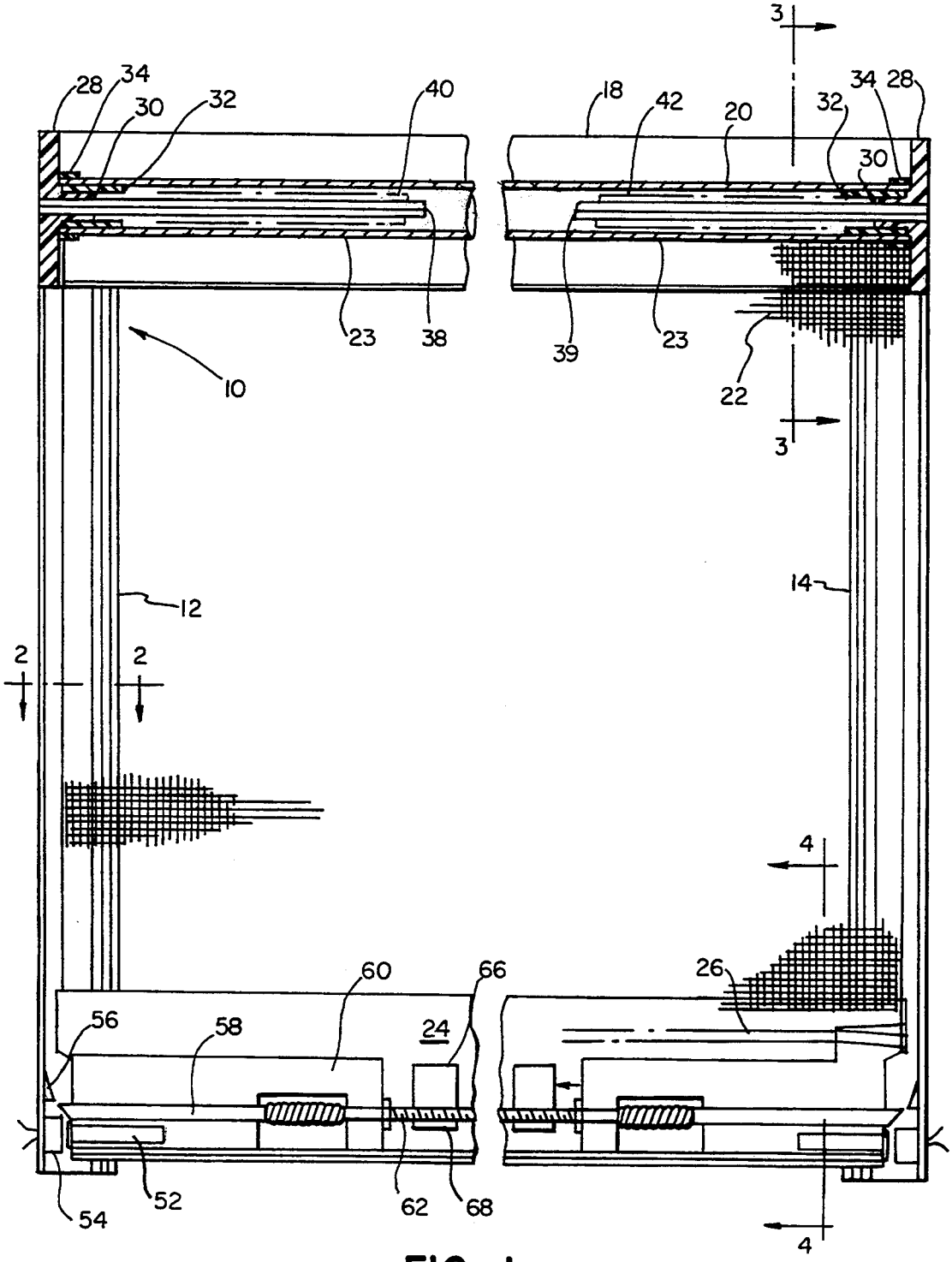
FIG. 1 is a front sectional view of a security screen embodying the invention, as seen from inside a building, taken on a plane parallel to and in front of the screen material.

A security screen embodying the invention includes a frame 10 comprised of symmetrical extruded hollow side channels 12,14 and a hollow top member 18 which contains a reel 20 upon which a length of screen material 22 is wound. The reel has a core 23 formed from a length of non-magnetic tubing, made preferably of a metal such as aluminum tubing or austenitic stainless steel. The free end of the screen is connected to an extruded aluminum drawbar 24 by means of a bead 25 which is retained in a slot 26 in the upper edge of the drawbar.

FIG. 1 shows the drawbar lowered, against the bottom of the window frame. In this position, the lateral edges of the screen are hidden within the side channels, as can be seen in FIG. 2, so that one cannot reach around the edges of the screen, from outside, to unlatch it. Optionally, buttons or plastic beads could be applied along the edges of the screen material, to prevent the edges from being pulled out of the undercut slots 27. Preferably, however, the vertical edges of the screen are simply maintained under slightly greater tension than the rest of the screen by the tapered inserts described below.

The top member 18 is a hollow rectangular parallelipiped or box whose end panels 28 have respective annular protrusions 30 that fit within and rotatably support plastic bearings 32 fixed in opposite ends of the reel's core 23. The upper edge of the screen material is permanently secured to the core, for example by collars 34 and screws, or by an adhesive.

Figure 6:
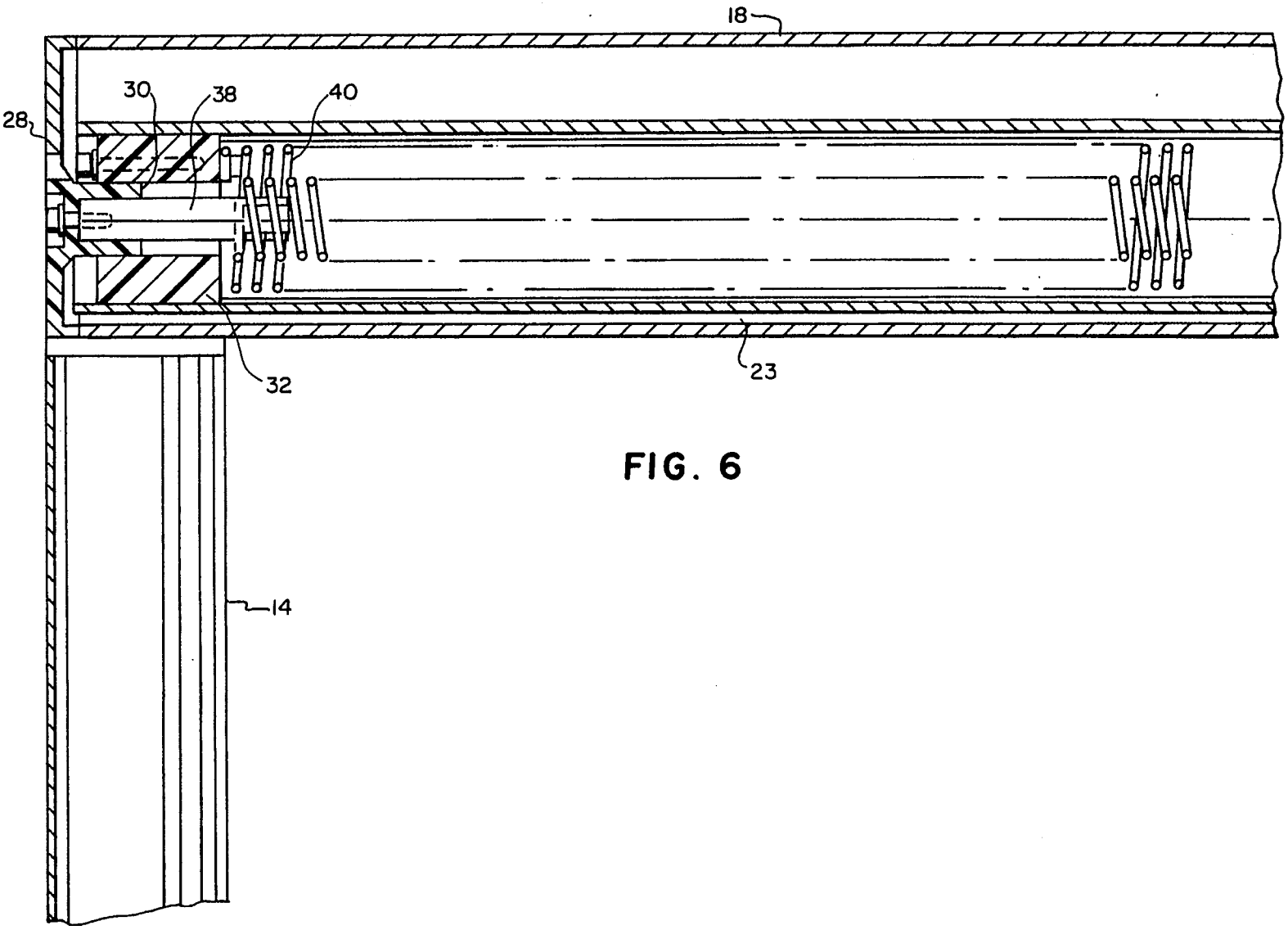
FIG. 6 shows an embodiment of the invention having double-wound torsion springs.

A pair of stub shafts 38,39 are seated within the respective annular protrusions 30, and thus are held concentrically within the reel, at either end thereof. Each stub shaft has a square or other non-circular cross-section, and the recess in which is seated has a corresponding shape, so that neither stub shaft can rotate. The inner end of each stub shaft is affixed to one end of a respective helical torsion spring 40,42. The other end of each springs is secured to one of the reel's bearings 32. The springs may have different configurations, depending on design requirements. FIG. 1 illustrates a simple pre-tensioned helical spring, surrounding a long stub shaft which extends the length of the spring: however, it may be preferred to use a double-wound spring, illustrated in FIG. 6, since the ends of such a spring are practically in the same plane, and thus only a very short stub shaft is needed. In fact, it may be possible to eliminate the stub shafts altogether. Regardless of which type of stub shaft and spring are used, it may be observed that they constitute assemblies which are narrow enough that can be used in screen units of greatly differing widths, down to a minimum of about twice the stub shaft length.

Each spring serves two functions: first, it draws the screen upward like a window shade; second, each spring serves as an electrical conductor, performing the function of a slip ring, without requiring sliding contact.

The screen material 22 is primarily non-conducting, being woven of a strong dielectric material such as PVC-coated fiberglass threads. At intervals, however, conductive wires 43 run lengthwise of the screen (top to bottom). These wires are woven into the screen material during its manufacture, or may be subsequently affixed. In either case, the conductors should not be readily distinguishable from the non-conductive strands.

Figure 5:
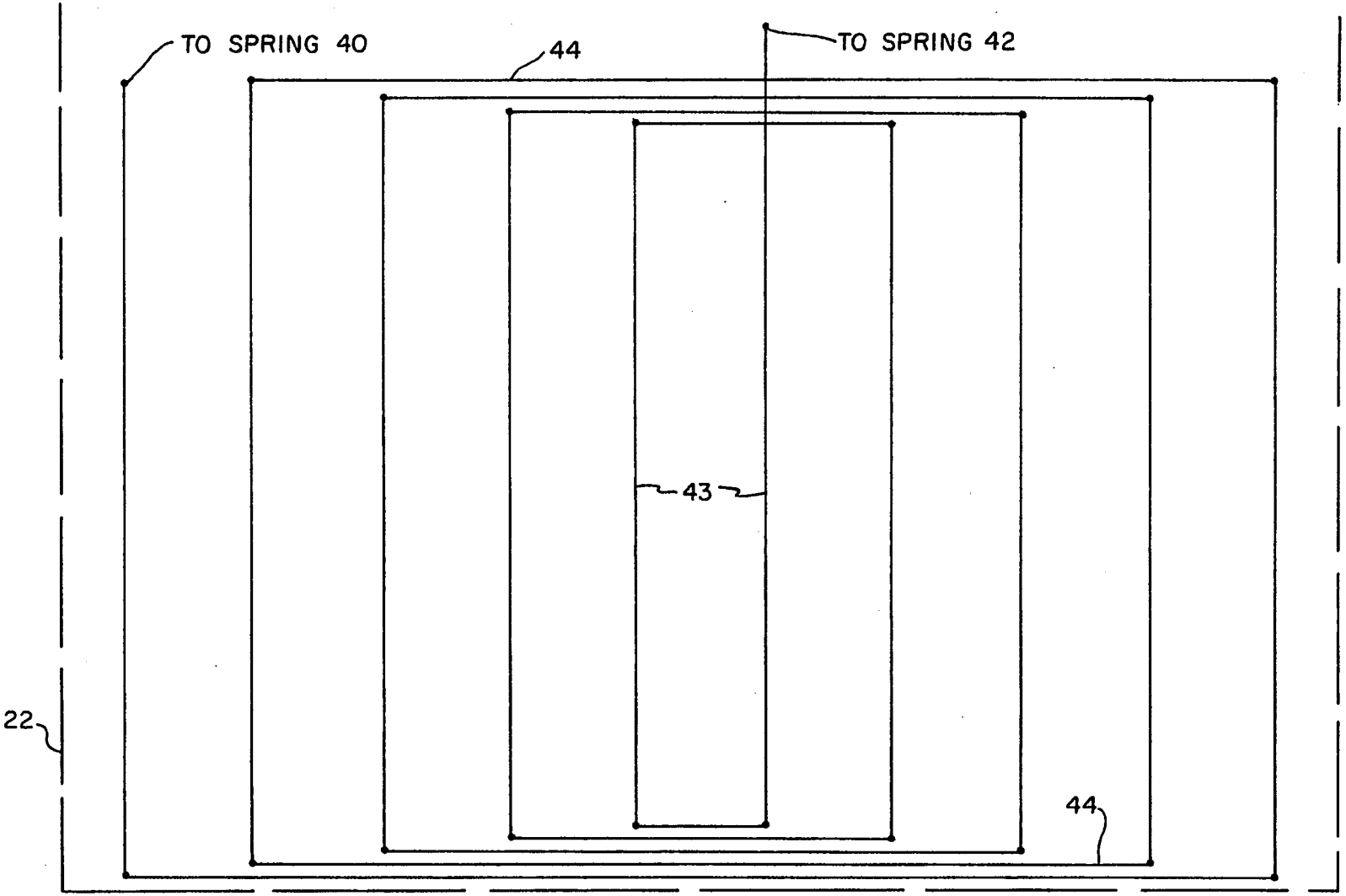
FIG. 5 is a diagram of the screen conductor path.

To make a continuous conductor path, so that no wire can be cut without breaking the circuit, the longitudinal wires are electrically interconnected by horizontal conductors 44, arranged in a novel pattern shown in FIG. 5. The horizontal conductors are applied to the screen at positions which are hidden in use, either within the top member 18, or within the drawbar 24. It can be seen that most, or at least some, of the horizontal conductors interconnect non-adjacent vertical conductors. That is, the electrical path is not the usual serpentine. Assuming a burglar could make out the vertical conductor wires in the screen, he would, most likely, assume they were connected conventionally. If this assumption led him to short-circuit adjacent wires before cutting through the screen, the alarm would sound.

FIG. 1 shows a wire which is secured to the movable end of the spring 40 and electrically connects it to one end of the screen conductor path. The inner end of the spring is mechanically and electrically connected to the end of the metal stub shaft 38, and an alarm wire is subsequently connected to the exposed outer end of the stub shaft. The opposite spring 42 likewise provides an electrical path between the other end of the screen conductor path and the opposite stub shaft 39, which is electrically isolated from the shaft 38. In this way, reliable, non-sliding electrical continuity is maintained between the alarm wires and the screen, even though the reel rotates through many revolutions as the screen is raised or lowered.

The screen conductors described above prevent people from cutting through the screen without being detected. One could enter, nevertheless, simply by raising the drawbar, if it were unlocked, or perhaps by pushing the screen inward with the drawbar still locked, bowing the screen enough that it could be bypassed laterally. To prevent either such mode of entry, there is a magnetic reel motion detector, comprising a permanent magnet 48 affixed to the reel, and a stationary magnetically activated sensor switch 50 installed in the top member 18 opposite the path of the magnet. See FIG. 3, which shows a gap between the magnet and the sensor switch sufficient to accommodate the thickness of the screen material rolled up on the reel when the screen is raised. During installation of the screen, the position of the magnet with respect to the switch is adjusted so that the magnet is opposite the switch (holding the switch "ON") when the screen is fully lowered. Any lifting of the drawbar, or pushing in on the screen, will thus open the switch to provide an indication of tampering, if the alarm is on.

Theoretically, one could hold the top of the screen somehow, to prevent the reel from turning (and thus "fool" the reel motion sensor), while he lifted the drawbar to gain entry to the building. So, to detect lifting of the drawbar from its lowermost (illustrated) position, a second, cylindrical, permanent magnet 52 is installed within the drawbar, at its outer end, facing a magnetic switch 54. For added safety, two such detectors may be installed, one at either end of the drawbar.

The sensor switches are connected to an alarm system, by wiring shown diagrammatically. Such systems are typically low voltage, to minimize the consequences of accidental shorts. Details of the remote alarm device are not part of this invention; it is a matter of ordinary skill to select an appropriate alarm unit, and to wire it. The number of conductors required between the screen unit and the alarm unit can be reduced to two if, as we prefer, the screen conductors and all magnetic switches are connected in series.

To lock the screen down, there are a pair of stops 56, one installed within each side member 12,14 at the bottom thereof, facing the end of the drawbar. The upper inner corner of each stop is beveled, for easy latching. The drawbar itself is an extruded hollow channel member, as shown in FIG. 4. A pair of plastic inserts 60 are inserted into the channel at either end. Each channel has a rectangular hole running lengthwise, and a sliding latch 58 is mounted in each rectangular hole. The end of the latch engages below the corresponding stop when the screen is drawn closed; its outer end is downwardly beveled so that the bar is driven inward when the screen is drawn down, past the stops 56.

The inner end of the latch member is joined to a threaded rod 62 that extends toward the center of the bottom member. A spring 64 shown in FIG. 1 around the rod normally keeps the latch member extended. One releases each latch by displacing it inwardly, toward the vertical center plane of the screen, by means of a finger pull 66 which is screwed into an internally threaded slider 68 mounted on the rod. The pull is accessible from the interior of the room, through the front channel slot. The nominal distance between the knobs can be adjusted, during assembly, but spinning the sliders on the rod.

By looking closely at FIG. 1, one can see that the top channel in the drawbar, which receives the screen's bottom bead, is not as wide as the screen. The outer inch or so of the screen bead is received in a slot in the insert; this slot forms an extension of the drawbar slot, except that it is depressed downward at about 5°. During assembly, the screen bead is first inserted into the drawbar slot. Then, the inserts are pushed in, effectively shortening the screen along its edges. When the screen is placed under tension, its edges are preferentially tightened, making it difficult to withdraw the screen edge from the slot.

Since screens must often be retrofitted into nonstandard windows, it is important to facilitate custom manufacture of the invention. All the channel members mentioned are easily cut to desired lengths by shearing or sawing; the screen can be cut to width, or provided in a variety of widths; and the reel can be shortened as well.

Inasmuch as the invention is subject to modifications and variations, it is intended that the foregoing description and the accompanying drawings shall be interpreted as illustrative of only one form of the invention, whose scope is to be measured by the following claims.

What is claimed is:

1. A security screen comprising a frame including a hollow top member and a pair of side members connected thereto, a screen reel rotatably supported within the top member by brackets at either end of the top member, a length of window screen material having an upper edge affixed to said reel, said screen being woven primarily from non-conductive threads, but also comprising a plurality of longitudinal electrical conductors running in a first direction, transverse conductor means interconnecting selected pairs of said parallel conductors to form therewith a single continuous electrical circuit which is interrupted if the screen is cut, a drawbar affixed along a lower edge of said screen, whereby the screen may be drawn down from the reel by lowering the drawbar, a torsion spring disposed between the reel and the bracket to bias the reel in a rotary direction tending to wind the screen onto the reel when the drawbar is allowed to move upward, said spring having a movable end connected to said reel and a stationary second end, means for mechanically connecting said stationary second spring end to said bracket, and a stationary electrical terminal connected to the second spring end, wherein the movable end of the torsion spring is electrically connected to the continuous electrical path of the screen, and the stationary end of said spring may be electrically connected to an alarm system, whereby the spring serves as a non-sliding rotary electrical joint.

2. A security screen comprising a frame including a hollow top member and a pair of side members connected thereto, a screen reel comprising a rotatable core disposed within said top member, and a length of window screen material having an upper edge affixed to said core, said screen being woven primarily of non-conducting threads, but having a plurality of longitudinal electrical conductors therein running in a first direction, transverse conductors interconnecting selected pairs of said longitudinal conductors to form therewith a single continuous electrical circuit which is interrupted if the screen is cut, a drawbar affixed along a lower edge of said screen, whereby the screen may be drawn from the reel by lowering the drawbar, a pair of torsion springs for biasing the core in a rotary direction tending to wind the screen onto the core when the drawbar is allowed to move upward, each of said springs having a movable end connected to said reel and a stationary second end, and means for mechanically connecting said stationary second ends to said frame, without electrically interconnecting them, the movable ends of the torsion springs being electrically connected to opposite ends of said continuous electrical screen circuit, whereby said stationary ends of said springs may be electrically joined to an alarm system, and the springs serve as non-sliding rotary electrical joints.

3. The invention of claim 2, further comprising a pair of stops on said side members, and a corresponding pair of latch sliders retained within said drawbar for sliding movement toward or away from said stops, means for biasing said sliders toward their respective stops, and means for moving the sliders opposite the biasing means to release the drawbar.

4. The invention of claim 3, wherein said slider moving means comprises a finger hold accessible through a slot in said drawbar.

5. The invention of claim 4, further comprising a threaded rod interconnecting said finger hold and said sliding member, for altering the distance therebetween to accommodate different window sizes.

6. The invention of claim 2, wherein said side frame members are hollow and have vertically extending slots in their inner edges, and the screen has lateral edges which slide within said slots, said lateral edges being maintained more taught than the rest of the screen, so that they tend to remain within the slots.

7. The invention of claim 2, wherein each of said torsion springs is electrically connected to one of the screen conductor wires, and also is mechanically connected to the reel, by a clamp.

8. The invention of claim 2, wherein the means connecting the stationary end of the spring to the frame is a metal stub shaft concentrically disposed within said core and affixed to the frame.

9. The invention of claim 2, further comprising a magnetic sensor including a permanent magnet affixed to said core, and a magnetic switch affixed to said frame in close proximity to the path of said magnet.

10. The invention of claim 9, wherein said magnet is opposite said switch when the screen is fully lowered, whereby any raising of the screen will open the switch, 11. The invention of claim 10, wherein said switch is connected electrically in series with said screen circuit.

12. The invention of claim 2, further comprising a magnetic sensor including a permanent magnet affixed to said drawbar, and a magnetic switch affixed to the frame opposite the magnet when the screen is fully lowered, whereby any raising of the drawbar will open the switch.

13. The invention of claim 12, wherein said switch is connected electrically in series with said screen circuit.

14. The invention of claim 2, wherein said transverse conductors in the screen are concealed from view.

15. The invention of claim 14, wherein some of said transverse conductors are disposed within said drawbar.

16. The invention of claim 14, wherein some of said transverse conductors are disposed above said open area, within said top member, even when the screen is fully lowered.

17. The invention of claim 14, wherein most of said transverse conductors interconnect non-adjacent ones of said lengthwise conductors.

18. The invention of claim 14, wherein some of said transverse conductor interconnect non-adjacent ones of said lengthwise conductors.

* * * * *